United States Patent [19]

Bartley

[11] Patent Number: 4,860,381

[45] Date of Patent: Aug. 29, 1989

[54] BIB-BOWL

[76] Inventor: Tracy L. Bartley, P.O. Box S, Wharton, N.J. 07885

[21] Appl. No.: 294,218

[22] Filed: Jan. 9, 1989

Related U.S. Application Data

[63] Continuation-in-part of Ser. No. 172,333, May 20, 1988, abandoned.

[51] Int. Cl.[4] ..... A41B 13/10

[52] U.S. Cl. ..... 2/49 A; 2/49 R; 220/83; 220/85 H; 224/270

[58] Field of Search ..... 2/49 A, 49 R, 50, 51; 220/83, 85 H; 224/202, 205, 257, 270

[56] References Cited

U.S. PATENT DOCUMENTS

| | | | |
|---|---|---|---|
| D. 238,521 | 1/1976 | Andersson | 2/49 A |
| 1,979,632 | 11/1934 | McClure | 2/49 A |
| 2,169,080 | 8/1939 | Clark | 224/270 |
| 2,453,202 | 11/1948 | Densmore | 2/51 |
| 2,616,085 | 11/1952 | Bottolfsen | 2/49 A |
| 2,640,197 | 6/1953 | Murray | 2/49 R |
| 2,672,614 | 3/1954 | Zimmerman et al. | 2/49 A |
| 2,688,750 | 9/1954 | Mink | 2/49 A |
| 3,283,971 | 11/1966 | Jones | 224/202 |
| 4,114,199 | 9/1978 | Malan | 2/49 A |

FOREIGN PATENT DOCUMENTS

| | | | |
|---|---|---|---|
| 0001803 | of 1927 | Australia | 2/49 A |
| 0294854 | 8/1928 | United Kingdom | 224/257 |
| 0613048 | 11/1948 | United Kingdom | 2/49 R |
| 1022886 | 3/1966 | United Kingdom | 2/49 A |

*Primary Examiner*—Jimmy G. Foster
*Attorney, Agent, or Firm*—Alfred C. Hill

[57] ABSTRACT

A bib-bowl for use during feeding of a user comprises a bowl to carry food to be eaten by the user having a rim, a bottom, and a given portion adjacent the body of the user containing therein a circular slot having a predetermined length; and a sheet of material having fastening means to secure the material about the neck of the user and a given width adjacent the bowl, the material being threaded through the slot from the inside of the bowl to the outside thereof, the predetermined length and the given width having a predetermined relative value to cause the material to assume a concave channel configuration extending from the neck of the user to the bowl to enhance the return of food and liquid to the bowl when spilled.

18 Claims, 1 Drawing Sheet

BIB-BOWL

CROSS-REFERENCE TO RELATED APPLICATION

The present invention is a continuation-in-part application of application Ser. No. 172,333, filed May 20, 1988, now abandoned.

BACKGROUND OF THE INVENTION

The present invention relates to a protective garment for use during the feeding of infants, invalids, or handicapped persons and more particularly to a bib-bowl product to not only protect the infant, invalid, or handicapped person, but also to return food and liquid being fed to the infant, invalid, or handicapped person to the bowl attached to the bib.

In the course of the feeding of infants, invalids, and handicapped persons portions of food may become deposited on the infant, handicapped person, invalid or their clothes, or on the surface on which the food container and eating utensils are placed for serving purposes. Protective sheet-like garments, generally known as bibs, which depend from the infant's, invalid's, or handicapped person's neck have been utilized to minimize the deposition of food on the infant, invalid, or handicapped person and to simplify clean up after the meal. The soiled bib may be reused after cleaning, or disgarded if economically feasible.

In the confines of the home, the tray or table on which the food container is placed for serving is of known cleanliness, and proper cleaning materials and equipment are available for proper maintenance of clean sanitary conditions. When traveling with infants, invalids, or handicapped persons, it is often found necessary to feed the infant, invalid, or handicapped person in a commercial restaurant where the tables or tray-equipped high-chair may be in an unknown or obviously unsatisfactory state of cleanliness. Under such circumstances, it is also inconvenient or impossible to conduct a thorough cleaning of the tray or table surface prior to use, or clean the infant, invalid, or handicapped person, the bib and the tray or table after the feeding session.

The prior art discloses bib and tray combinations which are disposable or which can be easily cleaned whose sole purpose is to keep the infant, invalid, or handicapped person clean and to keep the surface of the serving area clean when food is spilled by the infant, invalid, or handicapped person. Such prior art are disclosed in U.S. Design Pat. No. 238,521, U.S. Pat. No. 453,490, U.S. Pat. No. 2,672,614, U.S. Pat. No. 2,688,750, U.S. Pat. No. 4,114,199, Australian Pat. No. 1803/26, and a British Pat. No. 1,022,886.

None of the above identified prior art patents and other prior art disclose a structure incorporating a bib and bowl combination where the bowl may be used as a serving vessel and the bib used as a protective garment for the infant, invalid, or handicapped user with the bowl and bib being so combined that the bib is caused to be concave in nature to form a channel configuration so that any liquid or food that is spilled by the user is returned to the bowl so that food is not wasted, nutrition is increased along with reducing stressful feeding sessions, dirty clothes, messy high-chairs and messy kitchen floors or rugs upon which the infant, invalid or handicapped person may be fed or may be feeding themselves.

SUMMARY OF THE INVENTION

An object of the present invention is to provide a bib-bowl combination that is an improvement over known prior art combinations so designed as to reduce stressful feeding sessions, dirty clothes, messy high-chairs, and messy floors and rugs upon which the user may be located during the feeding process which also reduces food waste and increases nutrition.

A feature of the present invention is the provision of a bib-bowl for use during feeding of a user comprising a bowl to carry food to be eaten by the user having a rim, a bottom and a given portion adjacent the body of the user containing therein a circular slot of predetermined length; and a sheet of material having means to fasten the material about the neck of the user and a given width adjacent the bowl, the material being threaded through the slot from the inside of the bowl to the outside thereof, the predetermined length and the given width having a predetermined relative value to cause the material to assume a concave channel configuration extending from the neck of the user to the bowl to enhance the return of food and liquid to the bowl when spilled.

BRIEF DESCRIPTION OF THE DRAWING

Above mentioned and other features and objects of the present invention will become more apparent by reference to the following description taken in conjunction with the accompanying drawing, in which.

DESCRIPTION OF THE PREFERRED EMBODIMENTS

Figure 1:
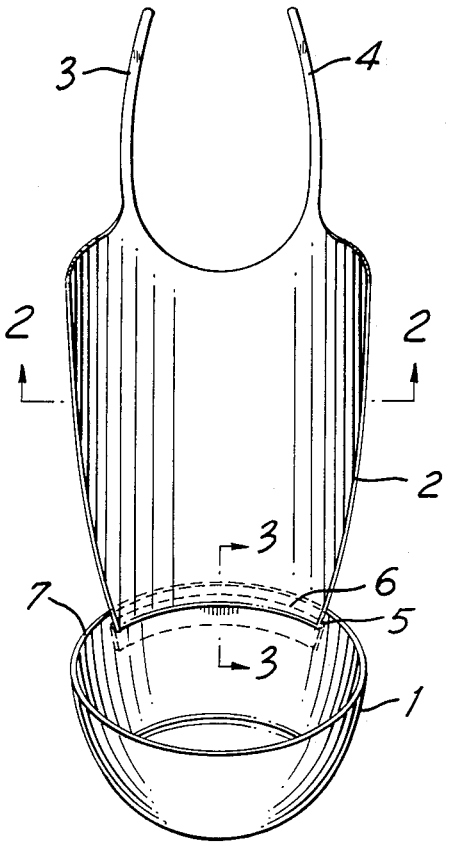
FIG. 1 is a prospective view of one embodiment of the bib-bowl combination in accordance with the principles of the present invention.
Figure 2:
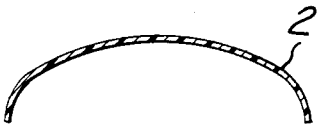
FIG. 2 is a cross-sectional view taken along line 2—2 of FIG. 1.

Referring to FIG. 1, the bib-bowl combination in accordance with the present invention includes a bowl 1 which is used to carry food to be eaten by the user, whether it is an infant, an invalid, or a handicapped person, or one of these users being fed by a caretaker. Attached to bowl 1 is a sheet of material which provides a bib 2 having means to fasten bib 2 about the neck of a user. These means may be in the form of snaps, ties 3 and 4 or straps containing Velcro material. Bib 2 has a predetermined width adjacent bowl 1 at 5 so that when bib 2 is threaded through a slot 6 of predetermined length provided in bowl 1 adjacent rim 7 thereof the relative length of slot 6 and the width of the material of bib 2 at 5 is such as to cause bib 2 to assume a concave channel configuration as shown in FIG. 2 extending from the neck of the user to bowl 1 to enhance the return of food and liquid to bowl 1 when spilled.

Figure 3:
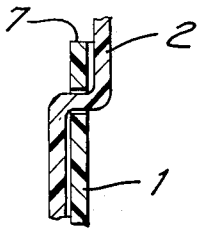
FIG. 3 is a cross-sectional view taken along line 3—3 of FIG. 1.

This material of bib 2 at 5 is threaded through slot 6 from the inside of bowl 1 to the outside thereof as illustrated in FIG. 3 to provide a leak resistant connection between bib 2 and bowl 1 so that food and liquid returned to bowl 1 from the concaved bib 2 will not leak through the connection between bib 2 and bowl 1 and soil the clothes of the user or the floor upon which the user is situated.

Bowl 1 preferably is a pliable plastic bowl approximately six inches in diameter and one and a half inches to three inches deep. In a reduction to practice a six inch long horizontal slot 6 was cut in bowl 1 approximately one inch below rim 7 of bowl 1. By applying pressure at rim 7 adjacent the top center of slot 6 space is provided for inserting bib 2. Bib 2 can vary in length and width but should be approximately twelve inches wide and fifteen inches long. Bib 2 is inserted from the inside of bowl 1 to the outside of bowl 1 as previously mentioned with the width of bib 2 at 5 being a width relative to the length of slot 6 so that the concave channel configuration is achieved. Personal adjustment of the length of bib 2 can be made by feeding bib 2 further through slit 6.

The connection between bib 2 and bowl 1 is achieved without the use of thumb screws as illustrated in U.S. Pat. No. 453,490 which could become loose and possibly swallowed along with the food taken in by the user.

As mentioned above bowl 1 can be a pliable plastic, but it could also be made of a disposable material.

The sheet material of bib 2 preferably has a slick surface to ensure the return of food and liquid to bowl 1 with the material preferably being a slick vinyl. Of course bib 2 could be a disposable material as could bowl 1 so that the bib-bowl combination could be disposed of after use so that clean up of the bowl 1 and bib 2 would not be a problem when on a trip with an infant, invalid, or handicapped person.

As shown in FIG. 1 slot 6 is provided in bowl 1 at a given portion of bowl 1 adjacent the body of the user at a point disposed adjacent rim 7 between rim 7 and bottom 8 of bowl 1. It has been found that it is very difficult using a mold to provide slot 6 adjacent rim 7 of bowl 1 between rim 7 and bottom 8.

Figure 4:
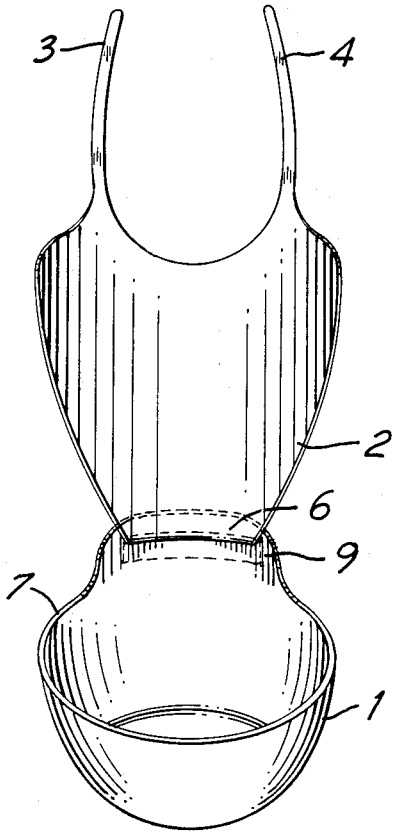
FIG. 4 is a prospective view of a second embodiment of the bib-bowl combination in accordance with the principles of the present invention.

Accordingly the embodiment shown in FIG. 4 was conceived which provides bowl 1 with an extension 9 extending from rim 7 toward the neck of the user with slot 6 being provided by a mold in extension 9 which is easier to provide than in the arrangement of FIG. 1. In all other respects the embodiment of FIG. 4 is the same as that of FIG. 1 particularly with regard to the formation of a concave channel configuration to enable the returning of the food and liquid to bowl 1 when spilled.

While I have described above the principles of my invention in connection with specific apparatus, it is to be clearly understood that this description is made only by way of example and not as a limitation to the scope of my invention as set forth in the objects thereof and in the accompanying claims.

I claim:

1. A bib-bowl for use during feeding of a user comprising:

a bowl to carry food to be eaten by said user having a rim, a bottom and a given portion adjacent the body of said user containing therein a circular slot of predetermined length; and a sheet of material having means to fasten said material about the neck of said user and a given width adjacent said bowl, said material being threaded through said slot from the inside of said bowl to the outside thereof, said predetermined length and said given width having a predetermined relative value to cause said material to assume a concave channel configuration extending from the neck of said user to said bowl to enhance the return of food and liquid to said bowl when spilled.

2. A bib-bowl according to claim 1, wherein said given portion is disposed between said rim and said bottom adjacent said rim.

3. A bib-bowl according to claim 2, wherein said material is non-absorbent.

4. A bib-bowl according to claim 2, wherein said material has a slick surface to ensure the return of food and liquid to said bowl.

5. A bib-bowl according to claim 4, wherein said material is a slick vinyl.

6. A bib-bowl according to claim 2, wherein said bowl and said material are made of disposable material.

7. A bib-bowl according to claim 2, wherein the length of said material may be adjusted to fit said user by controlling the amount of said material threaded through said slot.

8. A bib-bowl according to claim 1, wherein said given portion includes an extension extending from said rim towards the neck of said user.

9. A bib-bowl according to claim 8, wherein said material is non-absorbent.

10. A bib-bowl according to claim 8, wherein said material has a slick surface to ensure the return of food and liquid to said bowl.

11. A bib-bowl according to claim 10, wherein said material is a slick vinyl.

12. A bib-bowl according to claim 8, wherein said bowl and said material are made of disposable material.

13. A bib-bowl according to claim 8, wherein the length of said material may be adjusted to fit said user by controlling the amount of said material threaded through said slot.

14. A bib-bowl according to claim 1, wherein said material is non-absorbent.

15. A bib-bowl according to claim 1, wherein said material has a slick surface to ensure the return of food and liquid to said bowl.

16. A bib-bowl according to claim 15, wherein said material is a slick vinyl.

17. A bib-bowl according to claim 1, wherein said bowl and said material are made of disposable material.

18. A bib-bowl according to claim 1, wherein the length of said material may be adjusted to fit said user by controlling the amount of said material threaded through said slot.

* * * * *